US010204552B2

(12) United States Patent
Hung et al.

(10) Patent No.: US 10,204,552 B2
(45) Date of Patent: Feb. 12, 2019

(54) LIGHT-EMITTING DIODE DEVICE CONTROL METHOD

(71) Applicant: AU OPTRONICS CORPORATION, Hsin-chu (TW)

(72) Inventors: Sen-Chuan Hung, Hsin-chu (TW); Chi-Fu Tsao, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 20 days.

(21) Appl. No.: 15/408,611

(22) Filed: Jan. 18, 2017

(65) Prior Publication Data

US 2018/0190177 A1 Jul. 5, 2018

(30) Foreign Application Priority Data

Dec. 30, 2015 (TW) ..... 104144433 A

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2320/0257* (2013.01); *G09G 2320/043* (2013.01)

(58) Field of Classification Search
CPC ..... G09G 3/006; G09G 3/3233; G09G 3/325
See application file for complete search history.

(56) References Cited

U.S. PATENT DOCUMENTS

2006/0244695 A1* 11/2006 Komiya ..... G09G 3/006 345/76
2008/0143653 A1* 6/2008 Shishido ..... G09G 3/3233 345/78
2009/0237332 A1* 9/2009 Choi ..... G09G 3/325 345/76

FOREIGN PATENT DOCUMENTS

CN 104240634 A 12/2014

OTHER PUBLICATIONS

Office Action issued by the State Intellectual Property Office of the Peoples Republic of China dated Sep. 27, 2017 for Application No. CN 201610185974.0.

* cited by examiner

*Primary Examiner* — Sepehr Azari
(74) *Attorney, Agent, or Firm* — Tim Tingkang Xia, Esq.; Locke Lord LLP

(57) ABSTRACT

A light-emitting diode device control method includes using a reset voltage source to reset a control terminal of a driving-transistor of the light-emitting diode device; compensating the control terminal of the driving-transistor to a compensation voltage level; resetting a first terminal of the driving transistor to a target voltage level so as to increase a voltage difference between the first terminal and a second terminal of the driving transistor; and the driving transistor providing a driving current for driving a light-emitting diode of the light-emitting diode device to emit light.

5 Claims, 17 Drawing Sheets

LIGHT-EMITTING DIODE DEVICE CONTROL METHOD

CROSS-REFERENCE TO RELATED PATENT APPLICATION

This application claims the benefit of priority to Taiwan Patent Application No. 104144433, filed Dec. 30, 2015. The entire content of the above identified application is incorporated herein by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present invention relates to a light-emitting diode device control method, and in particular, to a light-emitting diode device control method that can increase a voltage difference between two terminals of a driving-transistor.

BACKGROUND

As the display technologies develop, light-emitting diodes have been widely applied to display technologies, for example, an Active-matrix organic light-emitting diode (AMOLED) is an example thereof. A control method thereof may be using a driving-transistor to provide current to drive a light-emitting diode to emit light. However, when a test is performed on displaying chess grids with alternate black and white grids, an Image Retention phenomenon will be occurred. For example, when a pixel turns from the gray scale brightness 0 (black) to the gray scale brightness 64 (gray), the brightness of the next image time will be excessively high, and the expected brightness may be achieved till the next image time. Besides, in high-speed applications, in a conversion process from a black image to an image of any gray scale, the expected gray scale brightness may be achieved generally by charging twice. This phenomenon may cause ghost image generated at an image intersection when the black image is turned to an image of any gray scale, so that the image quality of the high-speed display is poor. The unexpected image retention phenomenon is caused by charges aggregating at a channel of a driving-transistor.

SUMMARY

An embodiment of the present invention discloses a light-emitting diode device control method, including: using a reset voltage source to reset a control terminal of a driving-transistor of the light-emitting diode device; compensating the control terminal of the driving-transistor to a compensation voltage level; resetting a first terminal of the driving-transistor to a target voltage level, so as to increase a voltage difference between the first terminal and a second terminal of the driving-transistor; and the driving-transistor providing a driving current to drive a light-emitting diode of the light-emitting diode device to emit light.

Another embodiment of the present invention discloses a light-emitting diode device control method, including: providing a reset voltage to a control terminal of a driving-transistor of the light-emitting diode device; providing a compensation voltage level to the control terminal of the driving-transistor; after providing the compensation voltage level to the control terminal of the driving-transistor, providing a target voltage level to a first terminal of the driving-transistor; and after providing the target voltage level to the first terminal of the driving-transistor, the driving-transistor providing a driving current to drive a light-emitting diode of the light-emitting diode device to emit light.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
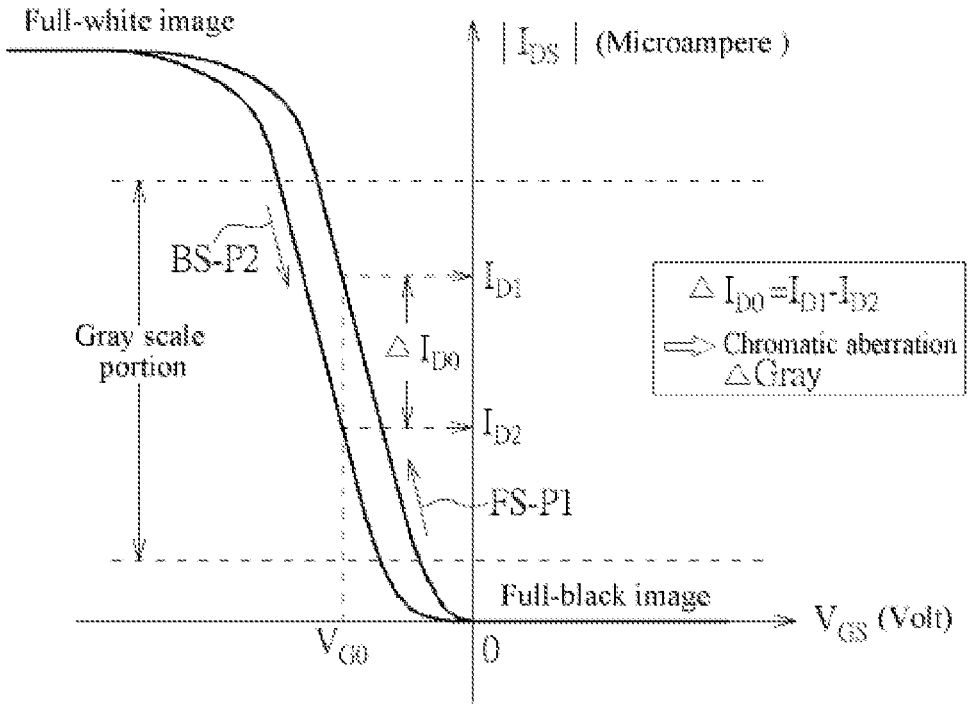
FIG. 1 is a schematic diagram of a current-voltage curve of a driving-transistor according to an embodiment of the present invention.

FIG. 1 is a schematic diagram of a current-voltage curve (I-V curve) of a driving-transistor according to an embodiment of the present invention. For the I-V curve of the driving-transistor, if a gate-to-source-drain voltage $V_{GS}$ is used as a horizontal axis (with a unit of volt), and an absolute value of a driving current $I_{DS}$ is used as a vertical axis (with a unit of microampere (uA)), a forward sweep path FS-P1 (corresponding to rising of the gray-scale brightness) of curve rising is different from a backward sweep path BS-P2 (corresponding to dropping of the gray-scale brightness) of curve dropping. The forward sweep path FS-P1 and the backward sweep path BS-P2 join when the driving-transistor is on/off, that is, they join corresponding to a full-white image/full-black image, but have different paths when being in a gray scale portion in the middle. It can be seen from FIG. 1, current values $I_{D1}$ and $I_{D2}$ of the forward sweep path FS-P1 and the backward sweep path BS-P2 corresponding to gate voltages $V_{GS}$ having the same level $V_{G0}$ are different, in other words, when the black picture turns to the gray scale and when the white picture turns to the gray scale, although the same voltage is applied, corresponding gray scale degrees are different. A current value difference $\Delta I_{D0}$ between the current values $I_{D1}$ and $I_{D2}$ causes a chromatic aberration ΔGray that needs to be eliminated, and therefore, the gray scale brightness change is not as expected, conversion cannot be finished within a predetermined time, so that the display quality is poor.

Figure 2:
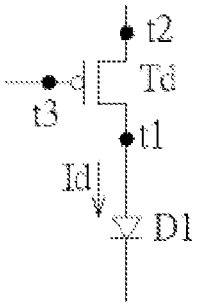
FIG. 2 is a schematic diagram of coupling a light-emitting diode and a driving-transistor according to an embodiment of the present invention.
Figure 3:
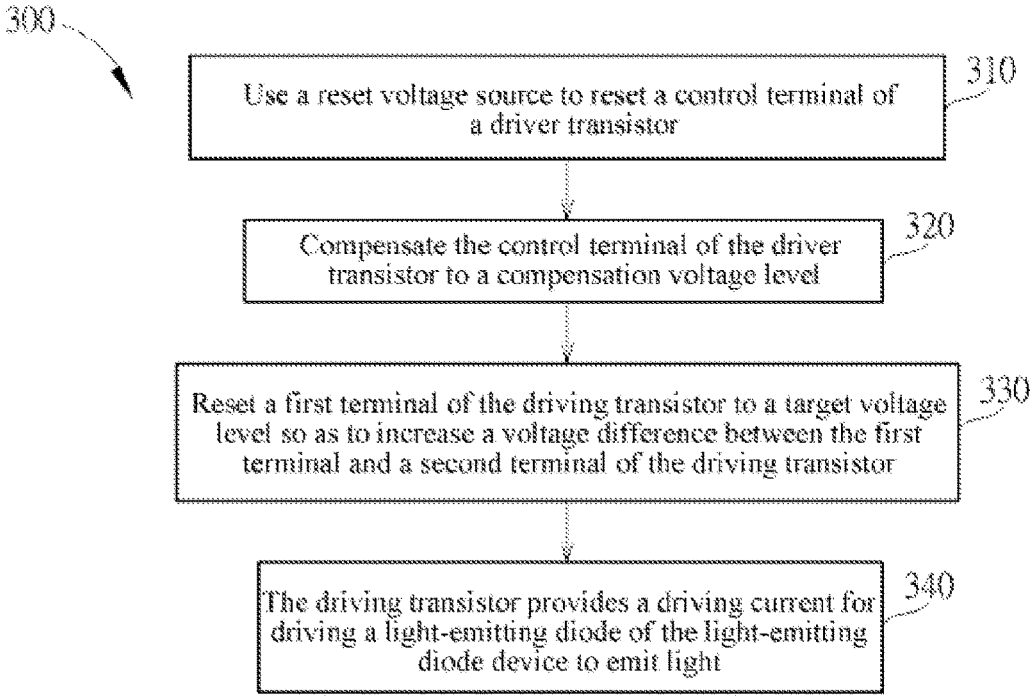
FIG. 3 is a flow chart of a light-emitting diode device control method according to an embodiment of the present invention.

FIG. 2 is a schematic diagram of coupling a light-emitting diode D1 and a driving-transistor Td according to an embodiment of the present invention. FIG. 3 is a flow chart of a light-emitting diode device control method 300 according to an embodiment of the present invention. The control method 300 may include:

Step 310: resetting a control terminal t3 of the driving-transistor Td;

Step 320: compensating the control terminal t3 of the driving-transistor Td to a compensation voltage level;

Step 330: resetting a first terminal t1 of the driving-transistor Td to a target voltage level, so as to increase a voltage difference between the first terminal t1 and a second terminal t2 of the driving-transistor Td; and Step 340: the driving-transistor Td providing a driving current Id to drive a light-emitting diode D1 of the light-emitting diode device to emit light.

FIG. 2 is merely a simplified schematic diagram used for describing the process of the operation, and a control circuit other than the driving-transistor Td and the light-emitting diode D1 is not shown, and circuits of light-emitting diode devices in the embodiments of the present invention are described in the following. According to the embodiment of the present invention, a P-type metal oxide semiconductor (PMOS) serving as a driving-transistor Td is used as an example, the control terminal t3 of the driving-transistor Td may be a gate terminal, the first terminal t1 may be a drain terminal, and the second terminal t2 may be a source terminal. In Step 310 to Step 320, the voltage of the control terminal t3 of the driving-transistor Td may be set again, and the voltage of the control terminal t3 of the driving-transistor Td is compensated, so as to correct element characteristic variation (for example, a threshold voltage variation ΔVth) caused by process drift. In Step 310, a reset voltage source may be used to reset the control terminal t3 of the driving-transistor Td.

In Step 330, the first terminal t1 of the driving-transistor Td is reset to the target voltage level, and the reset voltage source may be used to reset the first terminal t1 of the driving-transistor Td to the target voltage level; or a low voltage source may be used to reset the first terminal t1 of the driving-transistor Td to the target voltage level. Related operations are described in the following embodiments.

Figure 4:
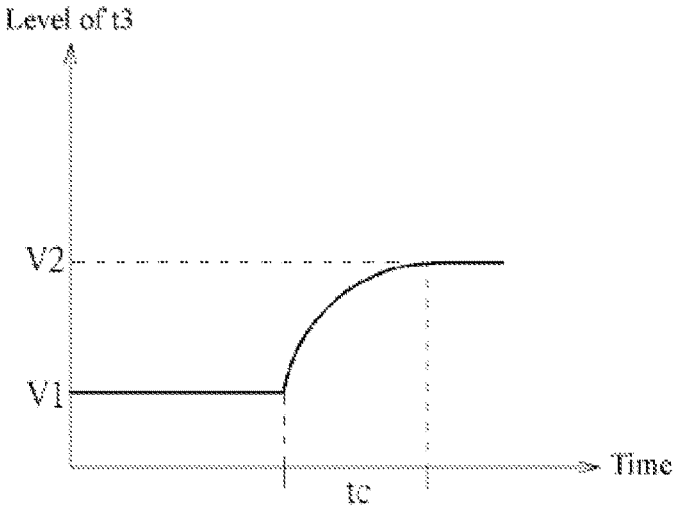
FIG. 4 is a corresponding curve graph of executing a compensation operation in a compensation phase according to the embodiment in FIG. 3.

The Step 310 to Step 340 may respectively correspond to a first reset phase, a compensation phase, a second reset phase and a light emitting phase. The timing of the four phases may be sequentially entering the first reset phase, entering the compensation phase, entering the second reset phase, and entering the light emitting phase, and then entering the first reset phase, operation is repeated according to the sequence, and the process enters the next phase after finishing the previous phase. FIG. 4 is a corresponding curve graph of executing a compensation operation in the compensation phase in Step 320 in the embodiment of FIG. 3. The horizontal axis of FIG. 4 is time, and the vertical axis thereof may be a level of the driving-transistor Td, and in the compensation phase, a level V1 may be compensated to a level V2 through charging, where time tc needs to be compensated. In Step 330, increasing the voltage difference (which may be a source-to-drain voltage $V_{SD}$) between the first terminal t1 and the second terminal t2 of the driving-transistor Td can make the driving-transistor Td to enter a deep saturation region, thereby preventing the driving-transistor from being located at a critical point of switching on/switching off to cause malfunction and an unstable driving current Id. According to the embodiment of the present invention, the control method 300 corresponds to circuits of the embodiments of the present application, and operation thereof is described as follows.

FIG. 5A to FIG. 5D are schematic operation circuit diagrams of a light-emitting diode device 500 according to an embodiment of the present invention. FIG. 6 is a schematic diagram of operation waveforms corresponding to FIG. 5A to FIG. 5D. In FIG. 5A to FIG. 5D, the light-emitting diode device 500 may include a driving-transistor 590, a first transistor 510, a second transistor 520, a third transistor 530, a fourth transistor 540, a fifth transistor 550, a light-emitting diode 580 and a charge storing unit C1. A second terminal of the driving-transistor 590 is coupled to a high voltage source OVDD, the light-emitting diode 580 has an anode and a cathode, and the cathode is coupled to a low voltage source OVSS. The first transistor 510 has a first terminal coupled to the first terminal of the driving-transistor 590, a control terminal (shown as being coupled to an end point S1), and a second terminal coupled to a reset voltage source $V_{INI}$. The second transistor 520 has a first terminal coupled to a reference voltage source $V_{REF}$, a control terminal, and a second terminal. The third transistor 530 has a first terminal used for receiving a data signal Data, a control terminal, and a second terminal coupled to the second terminal of the second transistor 520. The charge storing unit C1 has a first terminal coupled to the second terminal of the third transistor 530, and a second terminal coupled to the control terminal of the driving-transistor 590. The fourth transistor 540 has a first terminal coupled to the control terminal of the driving-transistor 590, a control terminal coupled to the control terminal (shown as being coupled to a common end point S2) of the third transistor 530, and a second terminal coupled to the first terminal of the driving-transistor 590. The fifth transistor 550 has a first terminal coupled to the first terminal of the driving-transistor 590, a control terminal coupled to the control terminal (shown as being coupled to a common end point EM) of the second transistor 520, and a second terminal coupled to the anode of the light-emitting diode 580. In FIG. 5A to FIG. 5D, a data level Data being 1.5 volts, a level of the reset voltage source $V_{INI}$ being 1 volt, and a level of the high voltage source OVDD being 5 volts are used as an example, and the values are used for exemplary illustration and are not intended to limit the scope of the present invention. Corresponding to FIG. 5A to FIG. 5D and FIG. 6, the operation of the control method 300 may be described in the following.

Figure 5A:
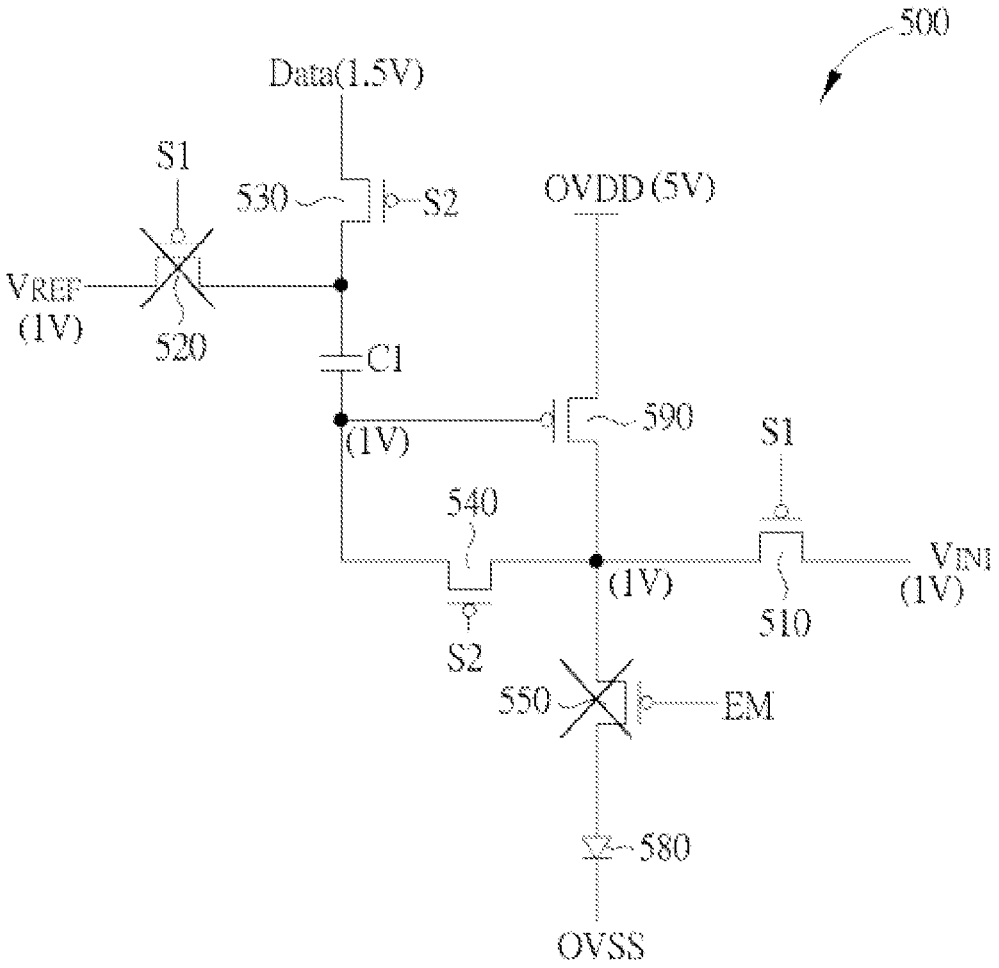
FIG. 5A to FIG. 5D are schematic operation circuit diagrams of a light-emitting diode device according to an embodiment of the present invention.
Figure 6:
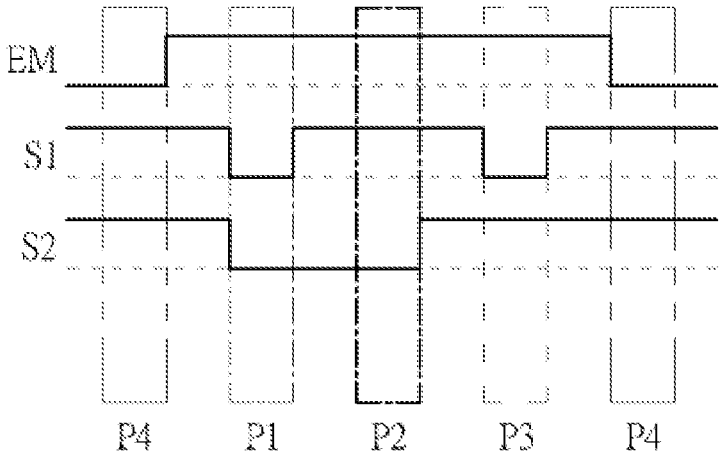
FIG. 6 is a schematic diagram of operation waveforms corresponding to FIG. 5A to FIG. 5D.

The Step 310 may correspond to FIG. 5A, and the using the reset voltage source $V_{INI}$ to reset the control terminal of the driving-transistor 590 of the light-emitting diode device 500 may include: switching off the second transistor 520 and the fifth transistor 550; and switching on the first transistor 510, the third transistor 530 and the fourth transistor 540. Corresponding to the first reset phase P1 in FIG. 6, an end point EM is in a high state, and end points S1 and S2 are in a low state. In this phase, the reset voltage source $V_{INI}$ may reset the control terminal of the driving-transistor 590 to, for example, 1 volt, by using the first transistor 510 and the fourth transistor 540. In FIG. 5A, a switched-off transistor is shown as being crossed, a switched-on transistor is shown as being not crossed, and so does the following description.

Figure 5B:
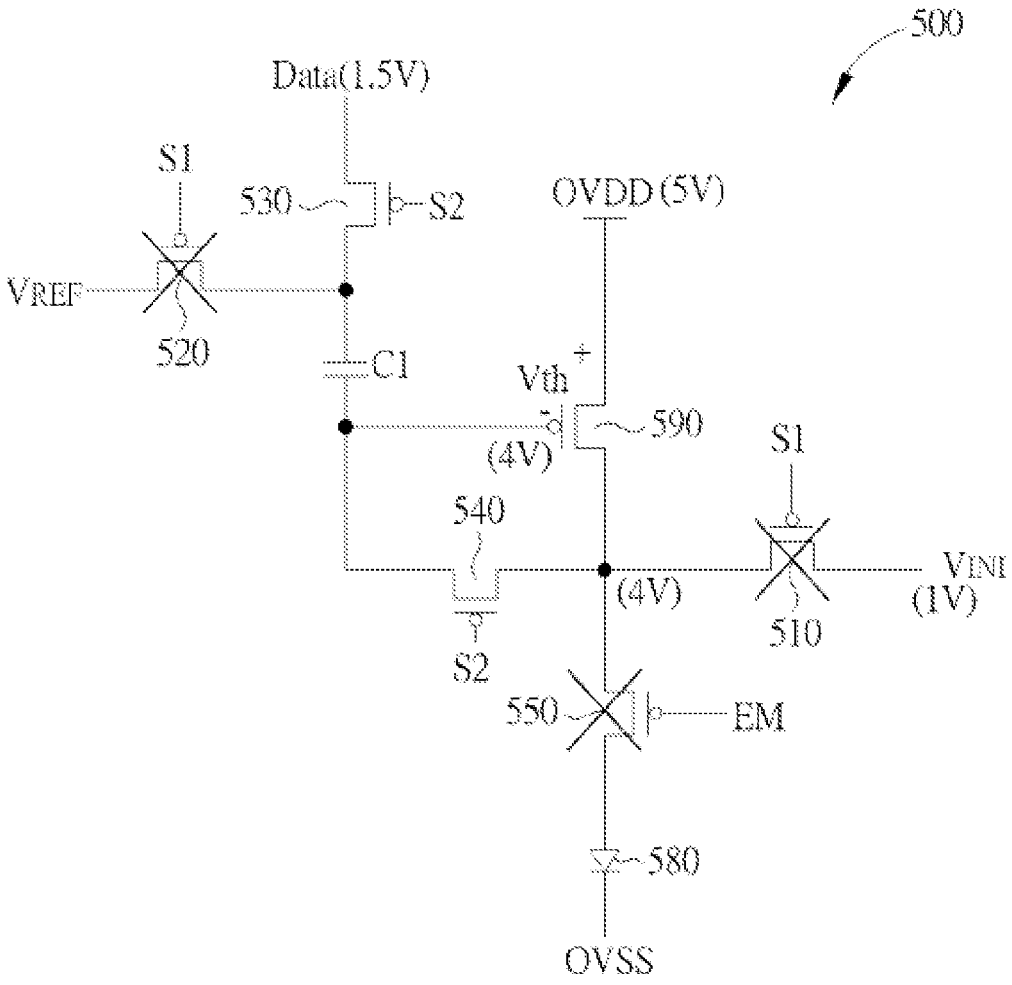

The Step 320 may correspond to FIG. 5B, and the compensating the control terminal of the driving-transistor 590 to the compensation voltage level may include: switching off the first transistor 510, the second transistor 520 and the fifth transistor 550; and maintaining the third transistor 530 and the fourth transistor 540 in an ON state. Corresponding to the compensation phase P2 in FIG. 6, the end point EM and the end point S1 are in the high state, and the end point S2 is in the low state. In this phase, the level of the control terminal of the driving-transistor 590 can be compensated to the compensation voltage level, that is, a difference between the level of the high voltage source OVDD and a threshold voltage Vth of the driving-transistor 590. If the threshold voltage Vth being 1 volt is used as an example, the level of the control terminal of the driving-transistor 590 may be compensated to 4 volts, as described in an equation (eq1):

$$OVDD-Vth=5V-1V=4V \quad \text{(eq1)};$$

Levels of the first terminal of the driving-transistor 590 and the second terminal of the fourth transistor 540 may also be raised to 4 volts by using the fourth transistor 540.

Figure 5C:
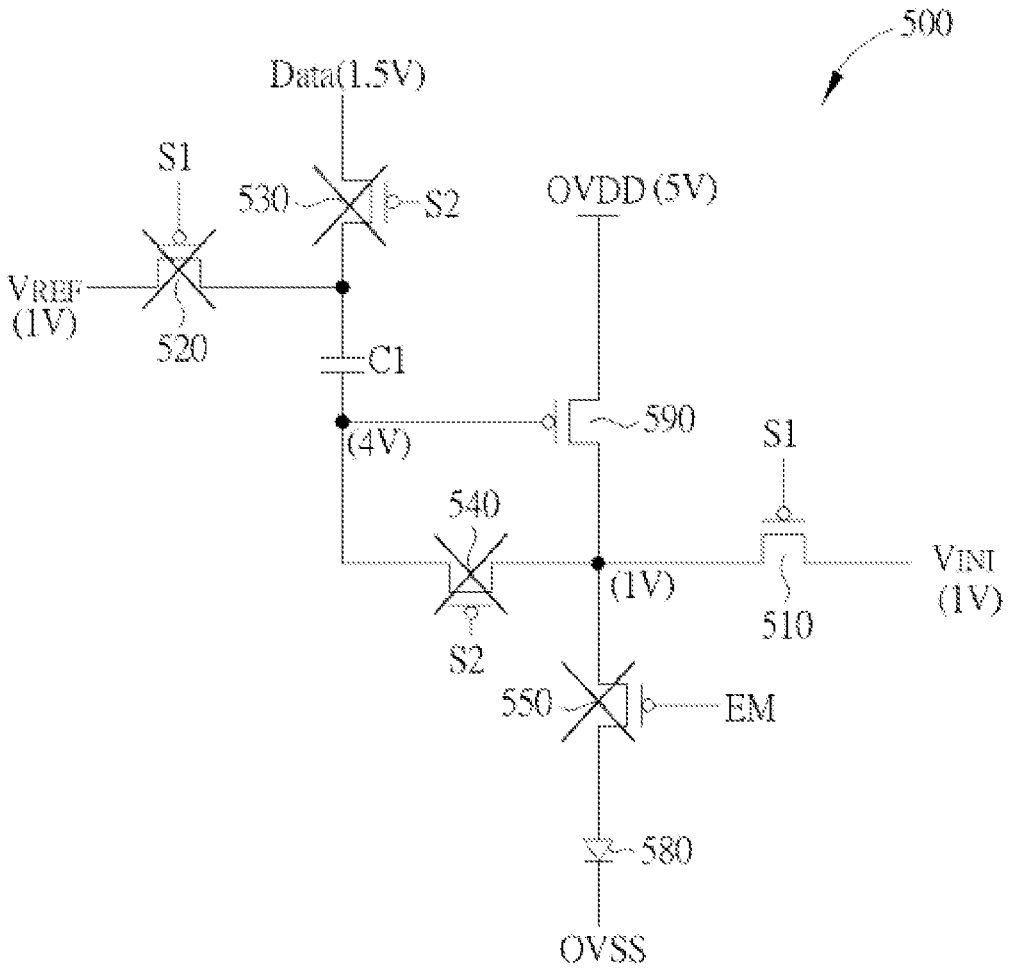
Figure 7:
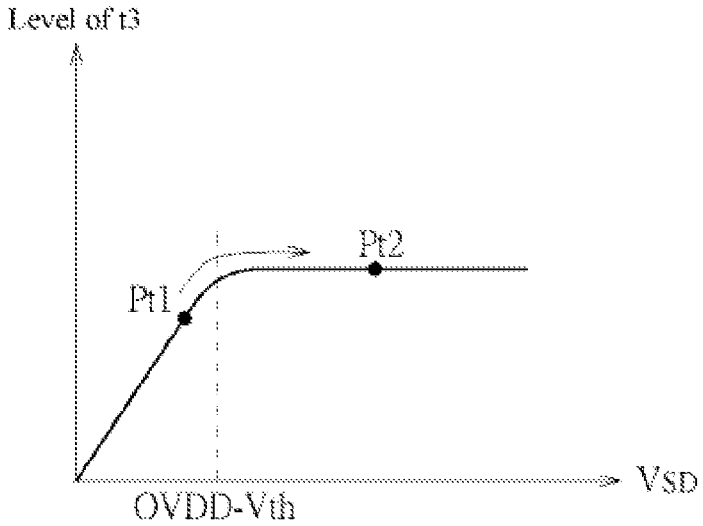
FIG. 7 is a corresponding schematic curve graph of a driving current and a source-drain voltage of a driving-transistor.

The Step 330 may correspond to FIG. 5C, and the using the reset voltage source $V_{INI}$ to reset the first terminal of the driving-transistor 590 to the target voltage level, so as to increase the voltage difference between the first terminal and the second terminal of the driving-transistor 590 may include: switching off the third transistor 530 and the fourth transistor 540; switching on the first transistor 510; and maintaining the second transistor 520 and the fifth transistor 550 in an OFF state. The first terminal of the driving-transistor 590 may be reset to the target voltage level, for example, 1 volt, by the reset voltage source $V_{INI}$ (a level thereof may be 1 volt) through the first transistor. Comparing FIG. 5B and FIG. 5C, the voltage difference between the first terminal and the second terminal of the driving-transistor 590 may be increased from 1 volt (OVDD−4V, that is, obtained by subtracting 4 volts from 5 volts) to 4 volts (OVDD−1V, that is, obtained by subtracting 1 volt from 5 volts). Therefore, the voltage difference between the first terminal and the second terminal of the driving-transistor 590 is increased. FIG. 7 is a corresponding schematic curve graph of the driving current Id and a source-drain voltage $V_{SD}$ of the driving-transistor 590. If the Step 330 is not executed, the source-drain voltage $V_{SD}$ of the driving-transistor 590 keeps at 1 volt, that is, less than the difference between the high voltage source OVDD and the threshold voltage Vth, and the excessively small source-drain voltage $V_{SD}$ will cause the excessively small driving current Id provided by the driving-transistor 590. After the Step 330 is executed, the source-drain voltage $V_{SD}$ of the driving-transistor 590 may increase accordingly, and corresponding to FIG. 7, it may move from a position pt1 to a position pt2 of the curve, and enter a deep saturation region, so that the current value of the driving current Id is large enough and stable, thereby being conducive to eliminating the problem of image retention in the prior art. The Step 330 and FIG. 5C may correspond to the second reset phase P3 in FIG. 6, where the end points EM, S2 are in the high state, and the end point S1 is in the low state, so as to control switching on and switching off of the transistors shown in FIG. 5C.

Figure 5D:
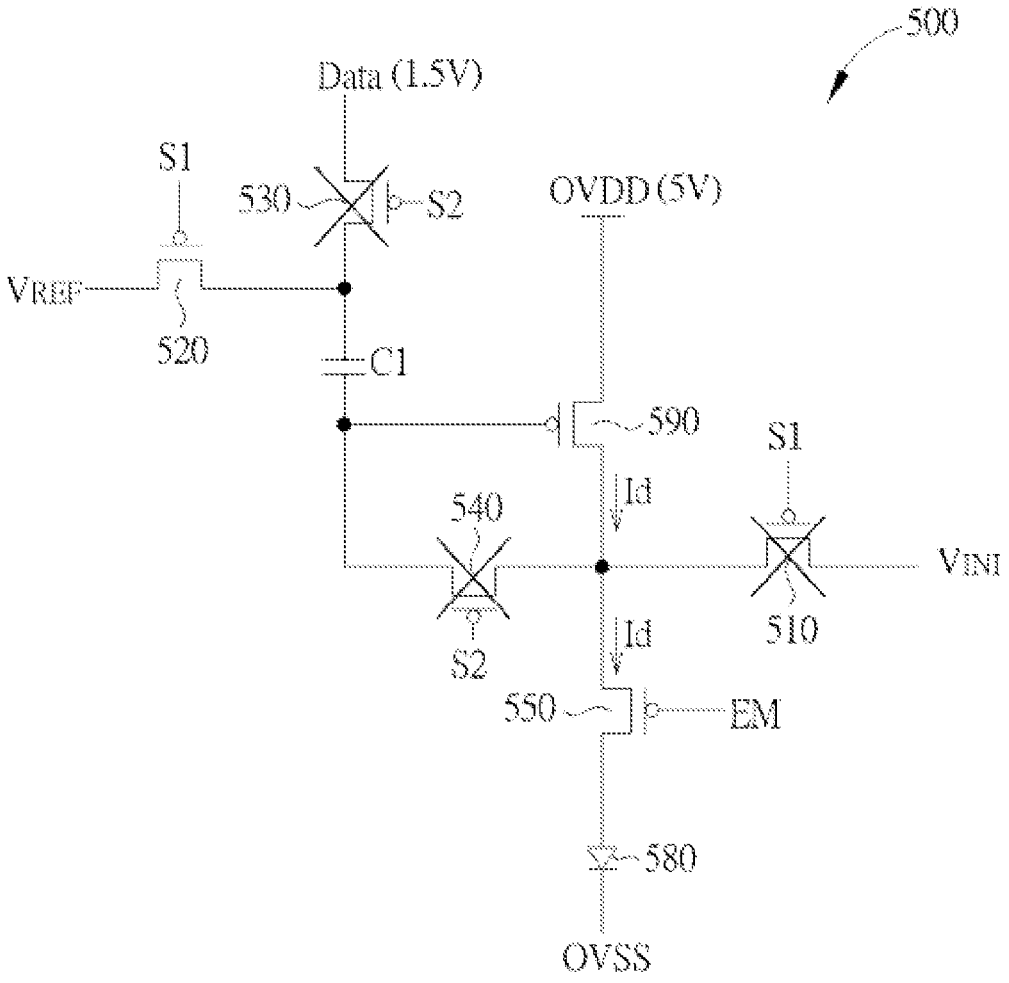

The Step 340 may correspond to FIG. 5D, and the driving-transistor 590 providing the driving current Id to drive the light-emitting diode 580 of the light-emitting diode device 500 to emit light may include: switching off the first transistor 510; switching on the second transistor 520 and the fifth transistor 550; and maintaining the third transistor 530 and the fourth transistor 540 in the OFF state. As shown in FIG. 5D, the driving current Id may drive, through the fifth transistor 550, the light-emitting diode 580 to emit light, and this phase may correspond to the light emitting phase P4 in FIG. 6, where the end point EM is in the low state, and the end points S1 and S2 are in the high state, thereby controlling switching on and switching off of the transistors shown in FIG. 5D.

FIG. 8A to FIG. 8D are schematic operation circuit diagrams of a light-emitting diode device 800 according to another embodiment of the present invention. FIG. 9 is a schematic diagram of operation waveforms corresponding to FIG. 8A to FIG. 8D. In FIG. 8A to FIG. 8D, the light-emitting diode device 800 may include a first transistor 810 to a sixth transistor 860, a charge storing unit C1, a driving-transistor 890, and a light-emitting diode 880. The light-emitting diode 880 has an anode coupled to a first terminal of the driving-transistor 890, and a cathode coupled to a low voltage source OVSS. The first transistor 810 has a first terminal coupled to the first terminal of the driving-transistor 890, a control terminal (coupled to an end point S1), and a second terminal coupled to a reset voltage source $V_{INI}$. The second transistor 820 has a first terminal coupled to a high voltage source OVDD, a control terminal (coupled to an end point EM), and a second terminal. The charge storing unit C1 has a first terminal coupled to the second terminal of the second transistor 820, and a second terminal coupled to a control terminal of the driving-transistor 890. The third transistor 830 has a first terminal coupled to a reference voltage source $V_{REF}$, a control terminal (coupled to an end point S2), and a second terminal coupled to the second terminal of the second transistor 820. The fourth transistor 840 has a first terminal coupled to the control terminal of the driving-transistor 890, a control terminal coupled to the control terminal of the third transistor 830 (shown as being coupled to the common end point S2), and a second terminal coupled to the first terminal of the driving-transistor 890. The fifth transistor 850 has a first terminal coupled to the high voltage source OVDD, a control terminal coupled to the control terminal of the second transistor 820 (shown as being coupled to the common end point EM), and a second terminal coupled to the second terminal of the driving-transistor 890. The sixth transistor 860 has a first terminal coupled to the second terminal of the driving-transistor 890, a control terminal (coupled to an end point S0), and a second terminal used for receiving a data signal Data.

Figure 8A:
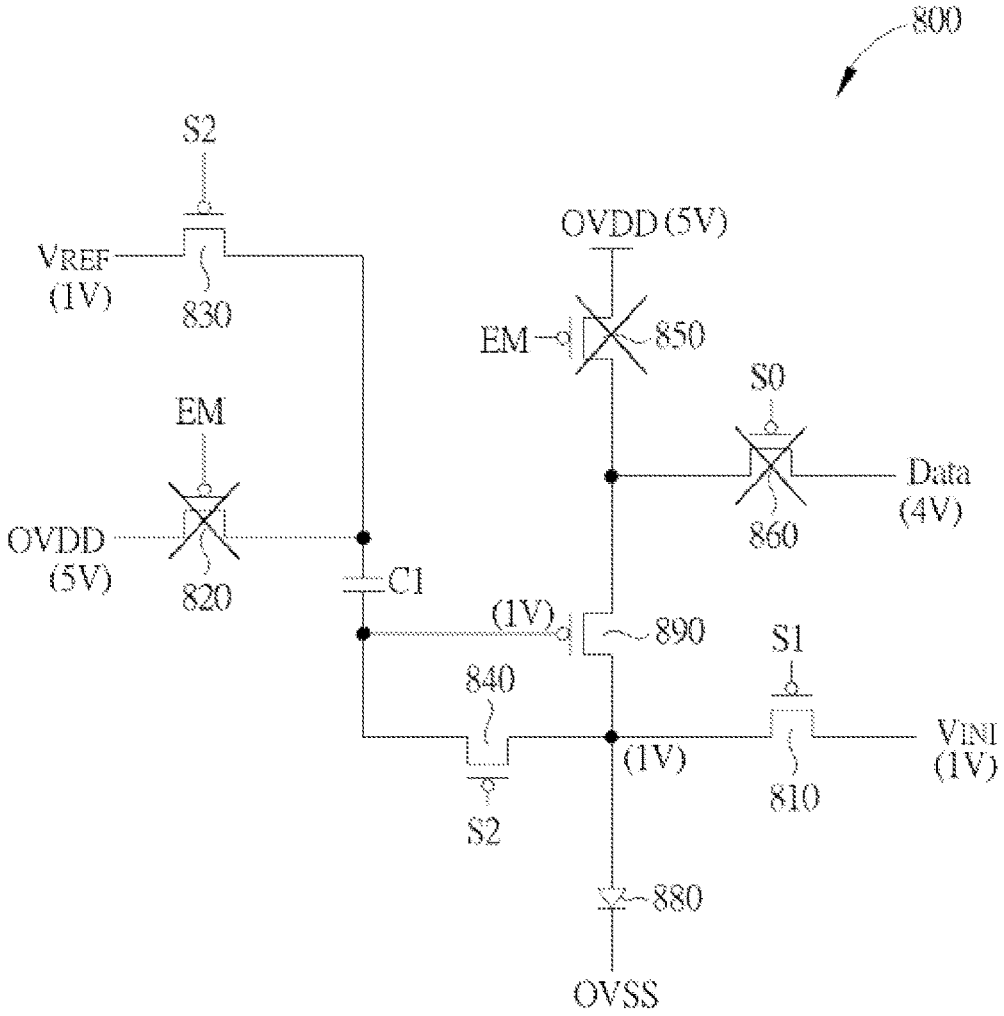
FIG. 8A to FIG. 8D are schematic operation circuit diagrams of a light-emitting diode device according to another embodiment of the present invention.
Figure 9:
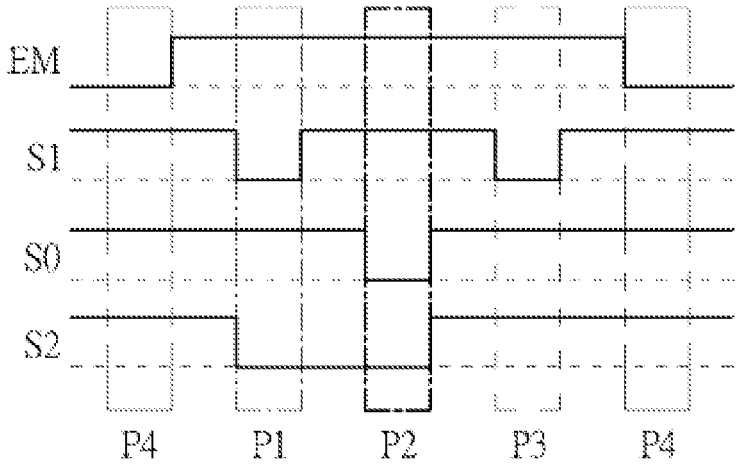
FIG. 9 is a schematic diagram of operation waveforms corresponding to FIG. 8A to FIG. 8D.

The Step 310 may correspond to a first reset phase P1 in FIG. 8A and FIG. 9, and using the reset voltage source $V_{INI}$ to reset the control terminal of the driving-transistor 890 of the light-emitting diode device 800 may include: by controlling levels of the end points S0, S1, S2 and EM to be in a high state or in a low state, switching off the second transistor 820 and the fifth transistor 850; switching on the first transistor 810, the third transistor 830 and the fourth transistor 840; and maintaining the sixth transistor 860 in a switch-off state. For example, the reset voltage source $V_{INI}$ (whose level may be, for example, 1 volt) may reset, through the first transistor 810 and the fourth transistor 840, the control terminal of the driving-transistor 890 to 1 volt.

Figure 8B:
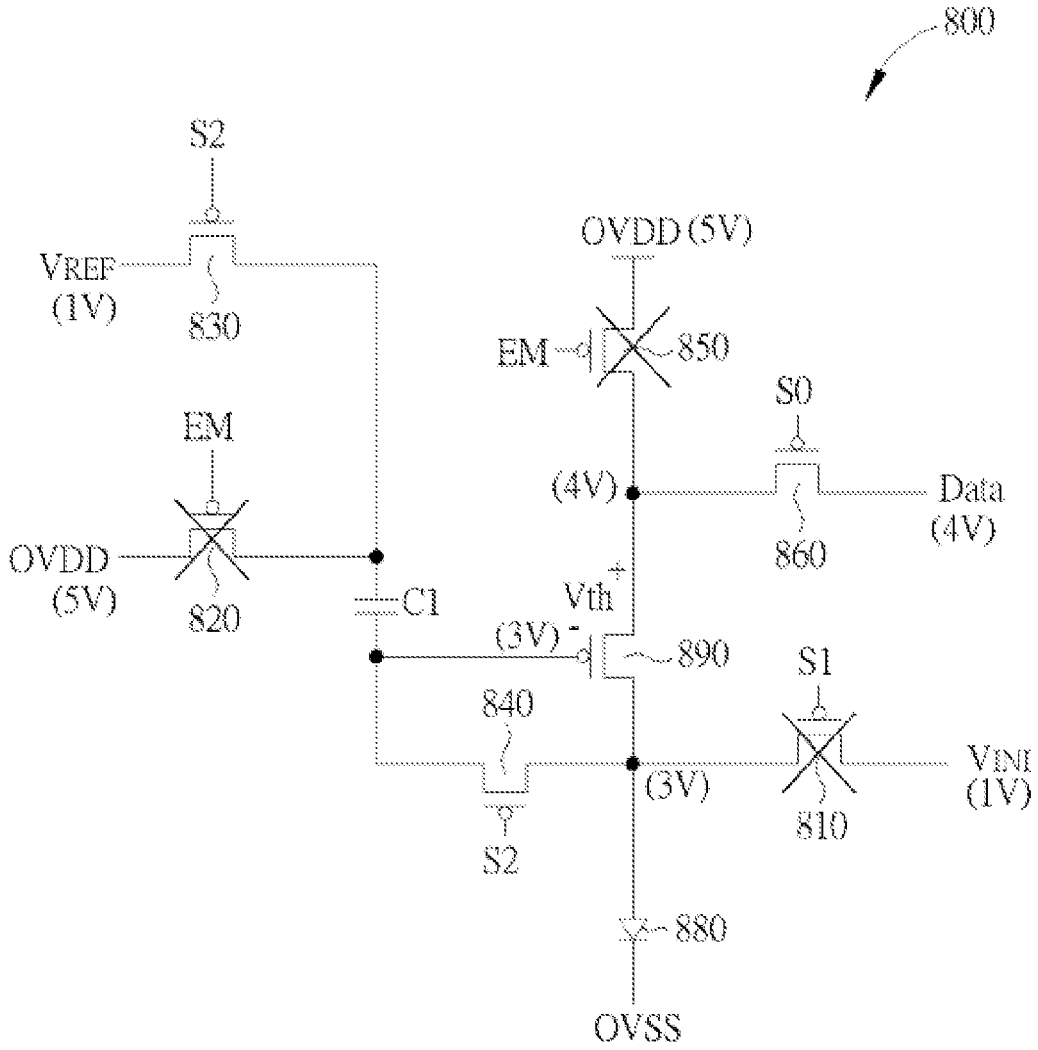

The Step 320 may correspond to a compensation phase P2 in FIG. 8B and FIG. 9, and compensating the control terminal of the driving-transistor 890 to a compensation voltage level may include: switching off the first transistor 810; switching on the sixth transistor 860; maintaining the second transistor 820 and the fifth transistor 850 in the switch-off state; and maintaining the third transistor 830 and the fourth transistor 840 in a switch-on state. The compensation voltage level may be a difference between a level (for example, 4 volts) of the data signal Data and a threshold voltage Vth of the driving-transistor 890, as described in an equation (eq2):

$$\text{Data}-Vth=4\text{V}-1\text{V}=3\text{V} \quad \text{(eq2)};$$

The data signal Data may compensate, through the sixth transistor 860, a level of the control terminal of the driving-transistor 890 to the compensation voltage level (for example, 3 volts).

Figure 8C:
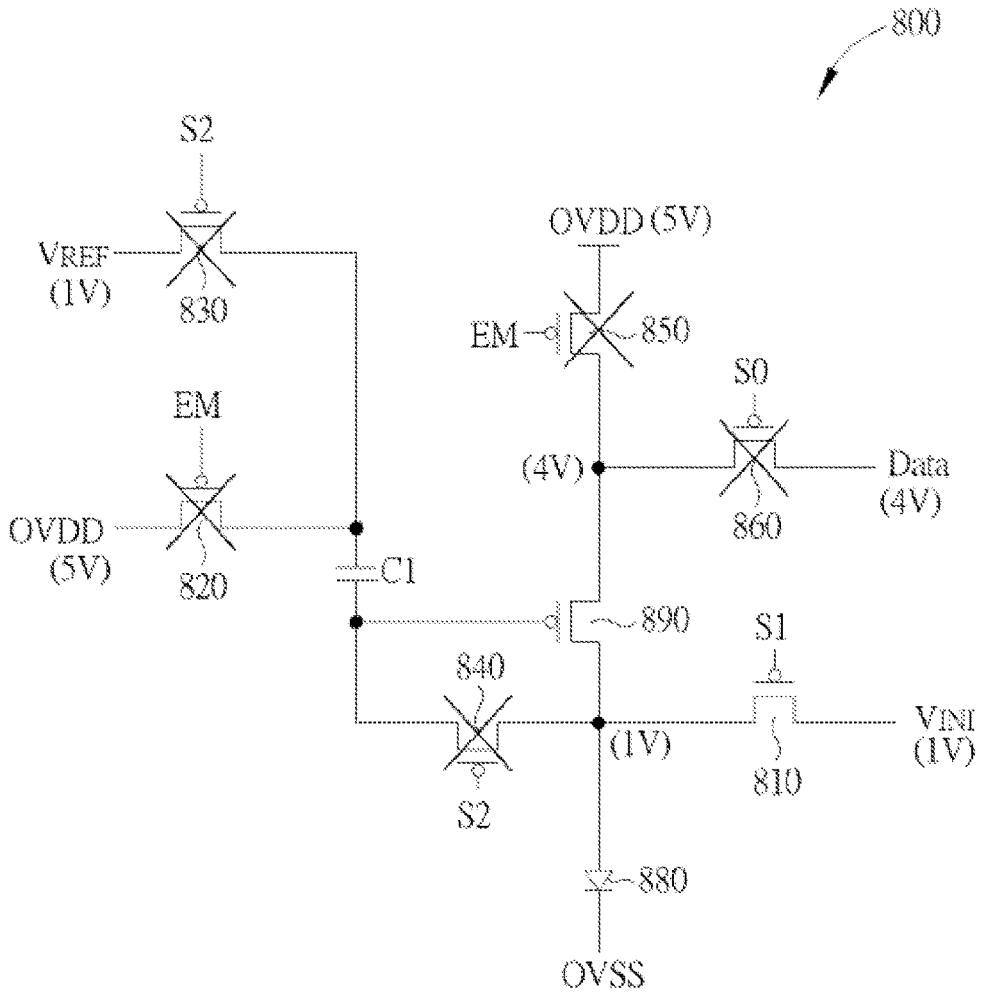

The Step 330 may correspond to a second reset phase P3 in FIG. 8C and FIG. 9, and using the reset voltage source $V_{INI}$ to reset the first terminal of the driving-transistor 890 to a target voltage level, so as to increase a voltage difference between the first terminal and the second terminal of the driving-transistor 890 may include: switching off the third transistor 830, the fourth transistor 840 and the sixth transistor 860; switching on the first transistor 810; and maintaining the second transistor 820 and the fifth transistor 850 in the switch-off state. It can be seen from FIG. 8B and FIG. 8C that, the reset voltage source $V_{INI}$ (whose level is, for example, 1 volt) may be used to reset, through the first transistor 810, the first terminal of the driving-transistor 890 to the target voltage level (for example, 1 volt), and therefore, the level of the first terminal of the driving-transistor 890 may, for example, drop from 3 volts to 1 volt, and the voltage difference between the first terminal and the second terminal of the driving-transistor 890 may be increased from the original 1 volt (subtracting 3 volts from 4 volts) to 3 volts (subtracting 1 volt from 4 volts). As the principle described in FIG. 7, increasing the voltage difference between the first terminal and the second terminal of the driving-transistor 890 may stabilize the driving current of the driving-transistor 890, thereby improving the display quality of the light-emitting diode.

Figure 8D:
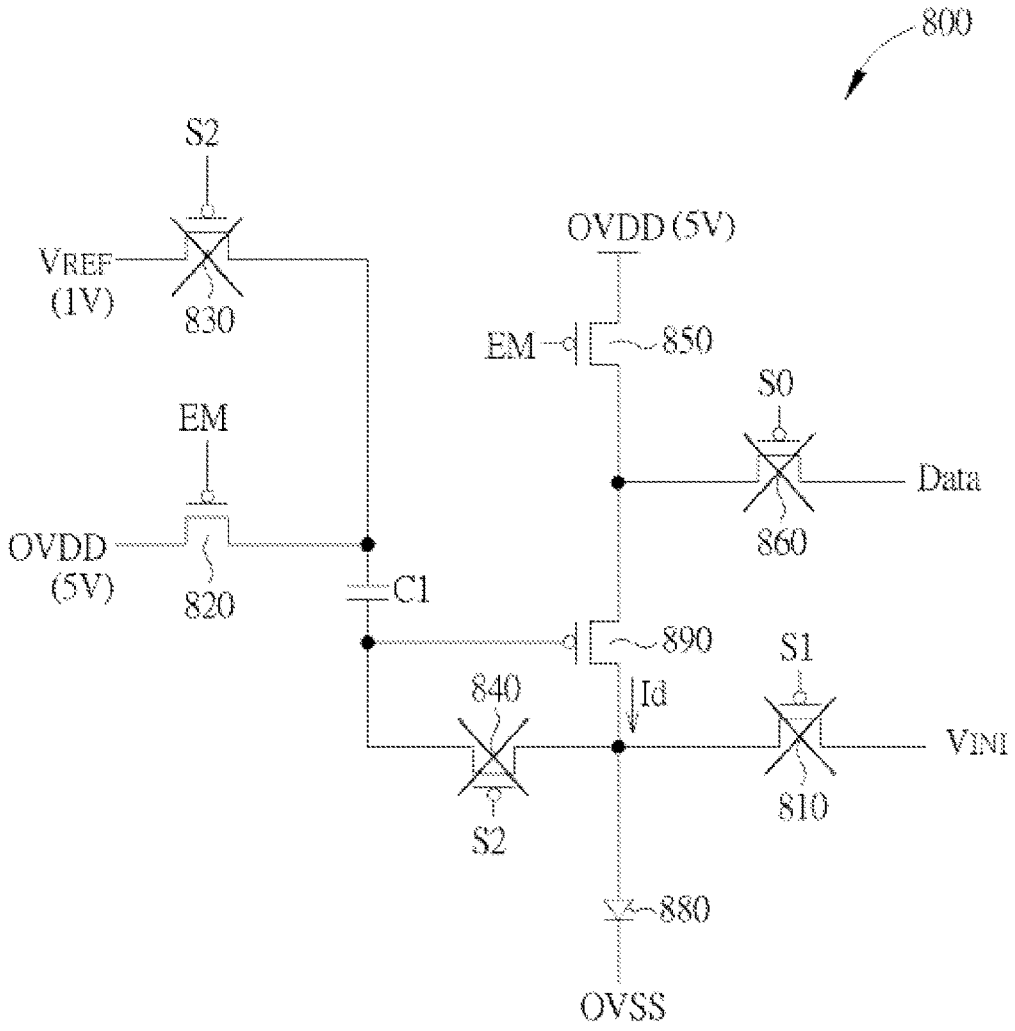

The Step 340 may correspond to a light emitting phase P4 in FIG. 8D and FIG. 9, the driving-transistor 890 providing the driving current Id to drive the light-emitting diode 880 of the light-emitting diode device 800 to emit light may include: switching off the first transistor 810; switching on the second transistor 820 and the fifth transistor 850; and maintaining the third transistor 830, the fourth transistor 840 and the sixth transistor 860 in the switch-off state.

FIG. 10A to FIG. 10D are schematic operation circuit diagrams of a light-emitting diode device 1000 according to another embodiment of the present invention. FIG. 11 is a schematic diagram of operation waveforms corresponding to FIG. 10A to FIG. 10D. The light-emitting diode device 1000 may include a first transistor 1010, a second transistor 1020, a third transistor 1030, a fourth transistor 1040, a fifth transistor 1050, a charge storing unit C1 and a light-emitting diode 1080. The first transistor 1010 has a first terminal coupled to a reset voltage source $V_{INI}$, a control terminal (shown as being coupled to an end point S1), and a second terminal coupled to a control terminal of the driving-transistor 1090. The second transistor 1020 has a first terminal coupled to the control terminal of the driving-transistor 1090, a control terminal (shown as being coupled to an end point S2), and a second terminal coupled to a first terminal of the driving-transistor 1090. The third transistor 1030 has a first terminal coupled to the first terminal of the driving-transistor 1090, a control terminal (shown as being coupled to an end point EM2), and a second terminal coupled to an anode of the light-emitting diode 1080. The fourth transistor 1040 has a first terminal used for receiving a data signal Data, a control terminal coupled to the control terminal of the second transistor 1020 (shown as being coupled to the common end point S2), and a second terminal coupled to a second terminal of the driving-transistor 1090. The fifth transistor 1050 has a first terminal coupled to a high voltage terminal OVDD, a control terminal (shown as being coupled to an end point EM1), and a second terminal coupled to the second terminal of the driving-transistor 1090. The charge storing unit C1 has a first terminal coupled to the high voltage terminal OVDD, and a second terminal coupled to the control terminal of the driving-transistor 1090.

Figure 10A:
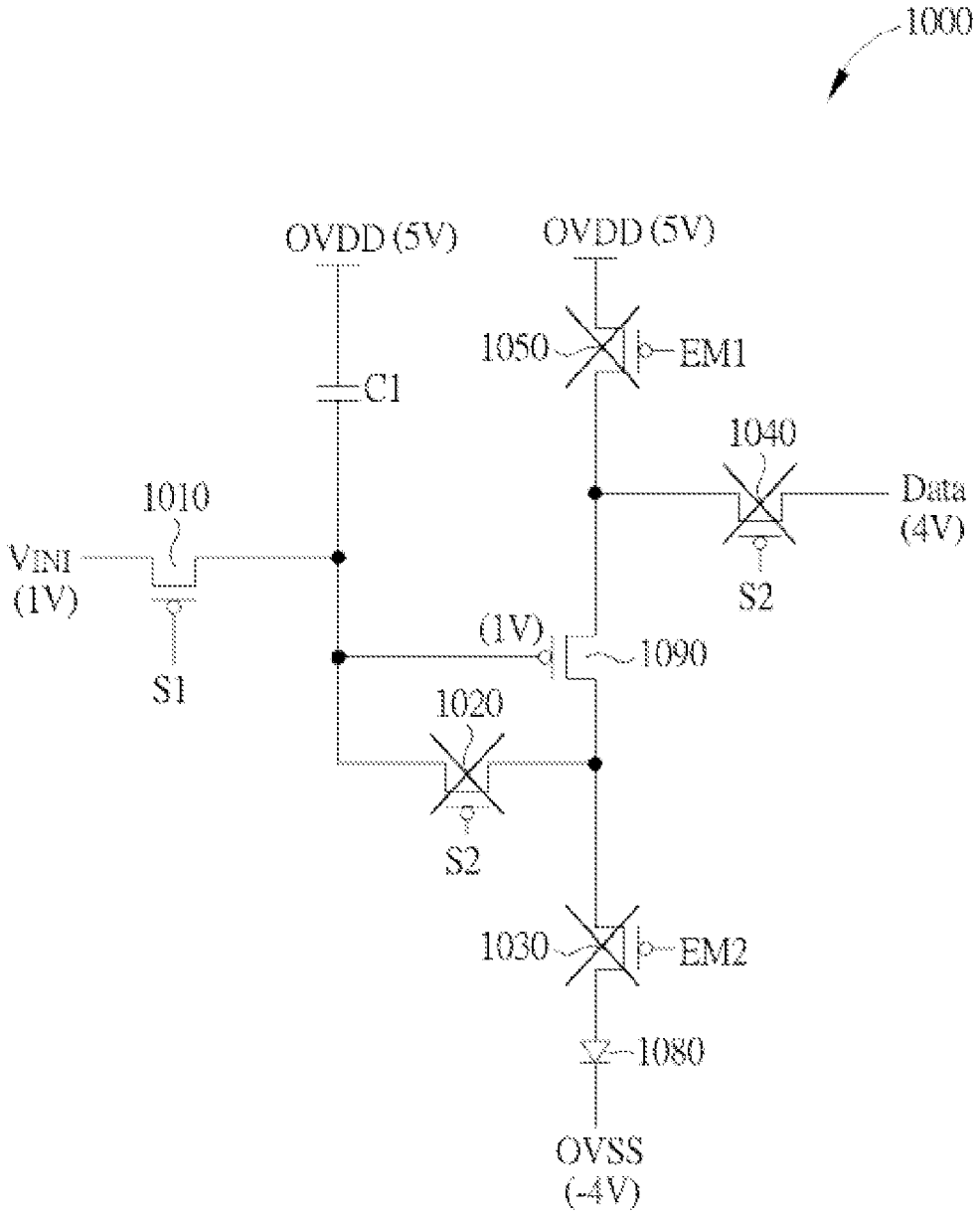
FIG. 10A to FIG. 10D are schematic operation circuit diagrams of a light-emitting diode device according to another embodiment of the present invention.
Figure 11:
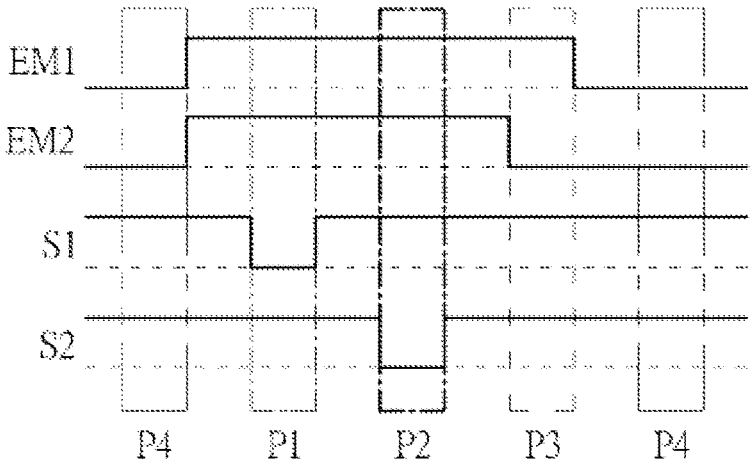
FIG. 11 is a schematic diagram of operation waveforms corresponding to FIG. 10A to FIG. 10D.

The Step 310 may correspond to a first reset phase P1 in FIG. 10A and FIG. 11, using the reset voltage source $V_{INI}$ to reset the control terminal of the driving-transistor 1090 of the light-emitting diode device 1000 may include: switching off the third transistor 1030 and the fifth transistor 1050; switching on the first transistor 1010; and maintaining the second transistor 1020 and the fourth transistor 1040 in a switch-off state. As shown by the first reset phase P1 in FIG. 11, a high state/low state of the end points S1, S2, EM1 and EM2 are adjusted to control switching on and switching off of the transistors. As shown in FIG. 10A, the reset voltage source $V_{INI}$ (whose level may be, for example, 1 volt) may reset, through the first transistor 1010, the control terminal of the driving-transistor 1090 of the light-emitting diode device 1000 to the level of, for example, 1 volt.

Figure 10B:
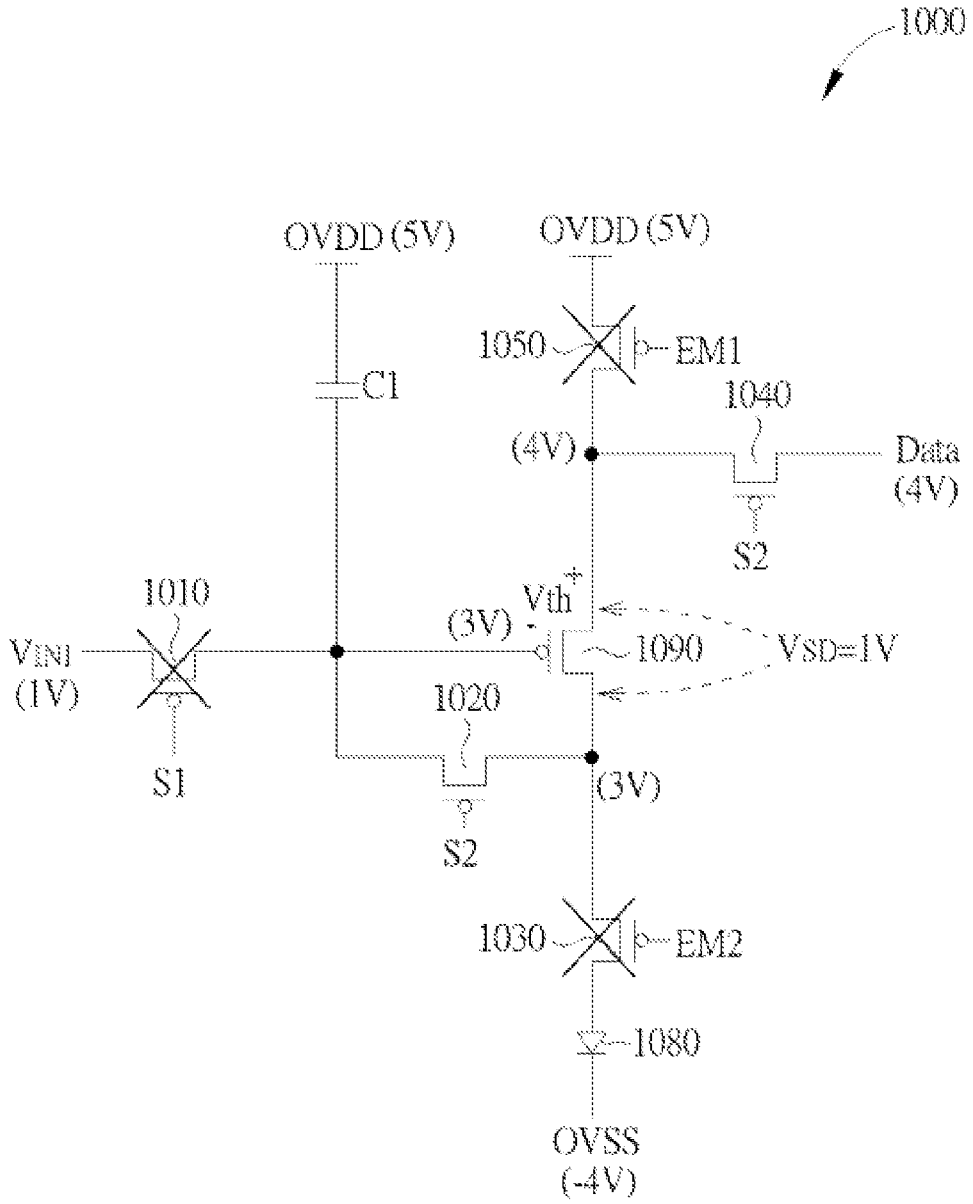

The Step 320 may correspond to a compensation phase P2 in FIG. 10B and FIG. 11, and compensating the control terminal of the driving-transistor 1090 to a compensation voltage level may include: switching off the first transistor 1010; switching on the second transistor 1020 and the fourth transistor 1040; and maintaining the third transistor 1030 and the fifth transistor 1050 in the switch-off state. As shown by the compensation phase P2 in FIG. 11, high state/low state of the end points S1, S2, EM1 and EM2 are adjusted to control switching on and switching off of the transistors. The compensation voltage level may be a difference between a level (for example, 4 volts) of the data signal Data and a threshold voltage Vth (for example, 1 volt) of the driving-transistor 1090, and by using FIG. 10B as an example, the compensation voltage level is 3 volts. Therefore, the first terminal of the driving-transistor 1090 is coupled to the control terminal of the driving-transistor 1090 through the second transistor 1020, so as to have a level of, for example, 3 volts, and the second terminal of the driving-transistor 1090 may have the level (for example, 4 volts) of the data signal Data through the fourth transistor 1040; therefore, a voltage difference between the first terminal and the second terminal of the driving-transistor 1090 may be, for example, 1 volt. If the second terminal and the first terminal of the driving-transistor 1090 are respectively a source terminal and a drain terminal, a source-drain voltage $V_{SD}$ of the driving-transistor 1090 may be, for example, 1 volt.

Figure 10C:
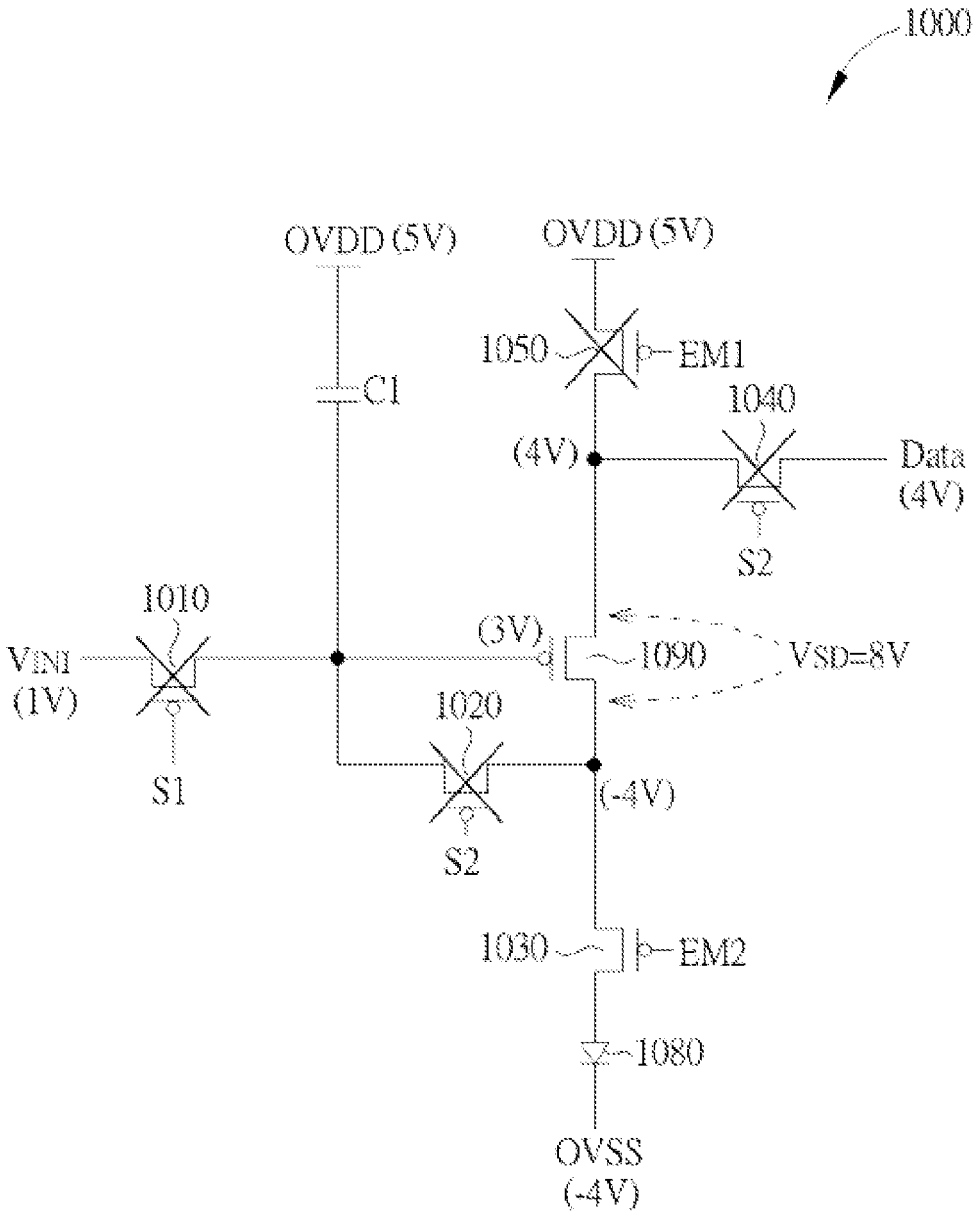

The Step 330 may correspond to a second reset phase P3 in FIG. 10C and FIG. 11, using the low voltage source OVSS to reset the first terminal of the driving-transistor 1090 to a target voltage level, so as to increase a voltage difference between the first terminal and second terminal of the driving-transistor 1090 may include: switching off the second transistor 1020 and the fourth transistor 1040; switching on the third transistor 1030; and maintaining the first transistor 1010 and the fifth transistor 1050 in the switch-off state. As shown by the second reset phase P3 in FIG. 11, the end points S1, S2 and EM1 are set to the high state, the end point EM2 is set to the low state, so as to control switching on or switching off of the transistors. The third transistor 1030 is switched on, and therefore, the low voltage source OVSS (whose level may be, for example, −4 volts) may drop, through the third transistor 1030, the first terminal of the driving-transistor 1090 to a low level, for example, −4 volts. Therefore, the voltage difference between the second terminal and the first terminal of the driving-transistor 1090 may be shown by, for example, the following equation (eq-3):

$$\begin{aligned}\text{A level of the second terminal of the driving-transistor 1090} - \text{a level of the first terminal of the driving-transistor 1090} &= 4\text{ V} - (-4\text{ V}) \\ &= 8\text{ V}\end{aligned} \quad \text{(eq-3)}$$

If the second terminal and the first terminal of the driving-transistor 1090 are respectively a source terminal and a drain terminal, a source-drain voltage $V_{SD}$ of the driving-transistor 1090 may be increased from 1 volt of FIG. 10B to 8 volts shown in FIG. 10C. Therefore, the driving-transistor 1090 may enter a deep saturation region, so that the driving current Id is more stable, the image retention problem is eliminated, and the display quality is improved.

Figure 10D:
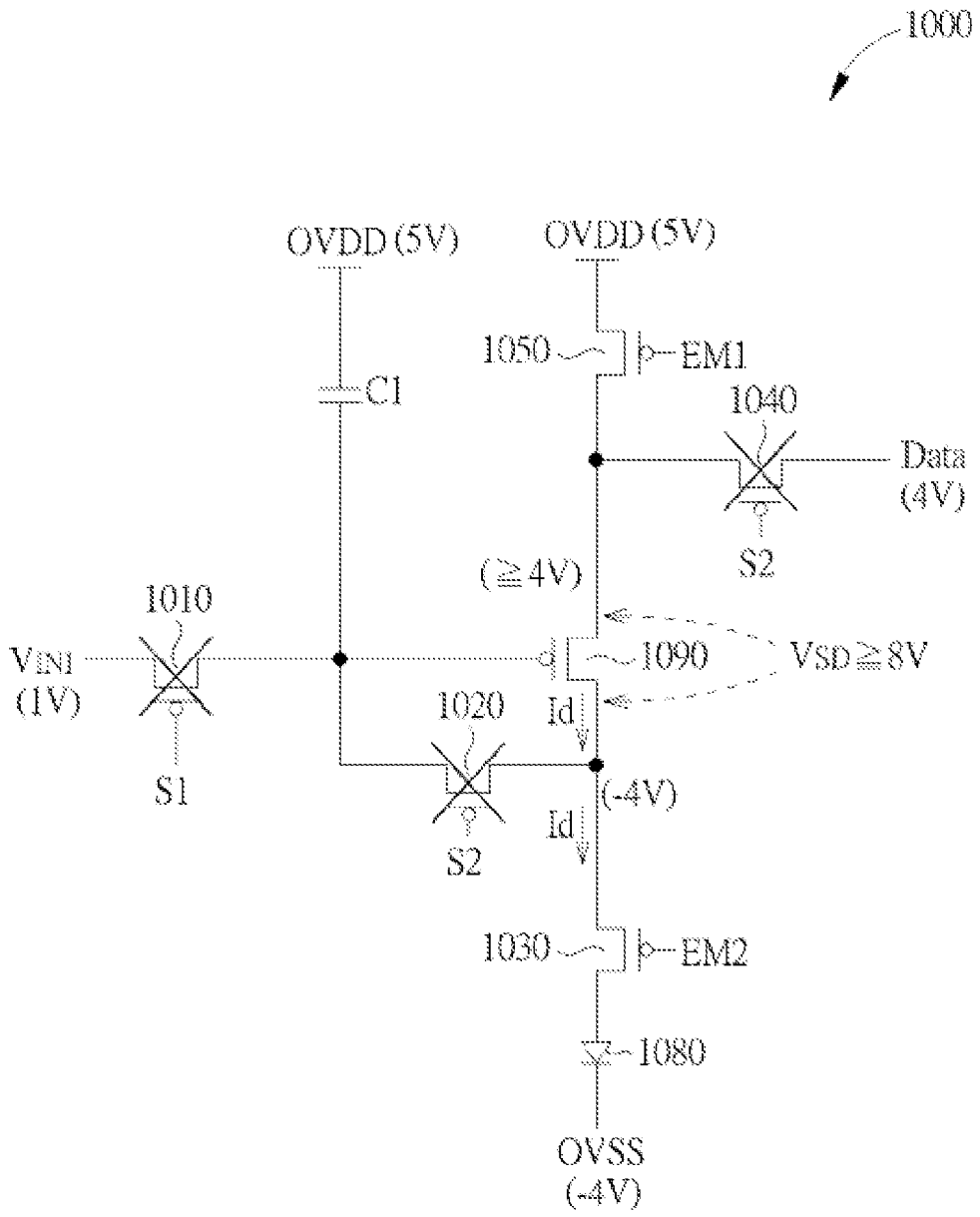

The Step 340 may correspond to a light emitting phase P4 in FIG. 10D and FIG. 11, the driving-transistor 1090 providing the driving current Id to drive the light-emitting diode 1080 of the light-emitting diode device 1000 to emit light may include: switching on the fifth transistor 1050; maintaining the third transistor 1030 in a switch-on state; and maintaining the first transistor 1010, the second transistor 1020 and the fourth transistor 1040 in the switch-off state. As shown by the light emitting phase P4 in FIG. 11, the end points S1, S2 may be in the high state, and the end points EM1, EM2 may be in the low state, so as to control switching on or switching off of the transistors. After the fifth transistor 1050 is switched on, the level of the second terminal of the driving-transistor 1090 may be further increased, and therefore, the source-drain voltage $V_{SD}$ of the driving-transistor 1090 may be increased from 8 volts shown in FIG. 10C to be more than 8 volts, so as to further enter the deep saturation region.

Level values of the end points and the voltage sources are merely used as examples, are used for assisting description of the principle of the embodiments of the present invention, and are not intended to limit the scope of the present invention. When the present invention is applied, level values of the end points may be set and adjusted according to factors such as process parameters, circuit design requirements, yield consideration, operation frequency, and operation power. The light-emitting diode may be (but not limited to) an organic light-emitting diode. The charge storing unit C1 may include a capacitor, or another electronic unit that can be used for storing charges. The transistors in the embodiments use p-type transistors as examples for illustration, but the present invention is not limited thereto, and if n-type transistors are used to implement the circuits and corresponding operation manners and operation waveforms of the present invention, it still falls within the scope of the present invention.

In view of the above, in the embodiments of the present invention, the voltage difference (for example, the source-drain voltage $V_{SD}$) between the first terminal and the second terminal of the driving-transistor is increased, so that the driving-transistor further enters the deep saturation region, and therefore, the driving current Id is more stable, the conversion speed of gray scale brightness is improved, as a result, the image retention problem in the prior art may be avoided effectively, and it is really advantageous in improving the display quality of a high frame rate application.

The preferred embodiments of the present invention are described, and equivalent variations and modifications made according to the claims of the present invention shall all fall within the scope of the present invention.

What is claimed is:

1. A light-emitting diode device control method, comprising:

using a reset voltage source to reset a control terminal of a driving-transistor of the light-emitting diode device;

compensating the control terminal of the driving-transistor to a compensation voltage level;

resetting a first terminal of the driving-transistor to a target voltage level, so as to increase a voltage difference between the first terminal and a second terminal of the driving-transistor; and providing a driving current to drive a light-emitting diode of the light-emitting diode device to emit light, wherein the resetting the first terminal of the driving-transistor to the target voltage level is using a low voltage source to reset the first terminal of the driving-transistor to the target voltage level;

wherein the light-emitting diode has an anode, and a cathode coupled to the low voltage source, and the light-emitting diode device further comprises:

a first transistor, having a first terminal coupled to the reset voltage source, and a second terminal coupled to the control terminal of the driving-transistor;

a second transistor, having a first terminal coupled to the control terminal of the driving-transistor, a control terminal, and a second terminal coupled to the first terminal of the driving-transistor;

a third transistor, having a first terminal coupled to the first terminal of the driving-transistor, and a second terminal coupled to the anode of the light-emitting diode;

a fourth transistor, having a first terminal used for receiving a data signal, a control terminal coupled to the control terminal of the second transistor, and a second terminal coupled to the second terminal of the driving-transistor;

a fifth transistor, having a first terminal coupled to a high voltage terminal, and a second terminal coupled to the second terminal of the driving-transistor; and the using the low voltage source to reset the first terminal of the driving-transistor to the target voltage level, so as to increase the voltage difference between the first terminal and the second terminal of the driving-transistor comprises:

switching off the second transistor, the fourth transistor, and the fifth transistor; and switching on the third transistor.

2. The control method according to claim 1, wherein the control terminal is a gate terminal, the first terminal is a drain terminal, and the second terminal is a source terminal.

3. The control method according to claim 1, wherein the light-emitting diode device further comprises:

a charge storing unit, having a first terminal coupled to the high voltage terminal, and a second terminal coupled to the control terminal of the driving-transistor;

the using the reset voltage source to reset the control terminal of the driving-transistor of the light-emitting diode device comprises:

switching off the third transistor and the fifth transistor; and switching on the first transistor;

the compensating the control terminal of the driving-transistor to the compensation voltage level comprises:

switching off the first transistor; and switching on the second transistor and the fourth transistor; and the driving-transistor providing the driving current to drive the light-emitting diode of the light-emitting diode device to emit light comprises:

switching on the fifth transistor.

4. The control method according to claim 1, wherein the compensation voltage level is a difference between a level of the data signal and a threshold voltage of the driving-transistor.

5. The control method according to claim 1, wherein the light-emitting diode is an organic light-emitting diode (OLED).

* * * * *